United States Patent [19]

Okazaki

[11] Patent Number: 4,744,162

[45] Date of Patent: May 17, 1988

[54] CONTAINER AND CLIP ASSEMBLY

[75] Inventor: Masayuki Okazaki, Gihu, Japan

[73] Assignee: Sanko Co. Ltd., Gihu, Japan

[21] Appl. No.: 893,210

[22] Filed: Aug. 5, 1986

[30] Foreign Application Priority Data

Jan. 17, 1986 [JP] Japan ..... 61-5742[U]

[51] Int. Cl.[4] ..... G09F 3/00

[52] U.S. Cl. ..... 40/312; 40/11 R; 40/10 R; 40/156

[58] Field of Search ..... 40/312, 11, 10, 156

[56] References Cited

U.S. PATENT DOCUMENTS

| | | | |
|---|---|---|---|
| 276,980 | 8/1883 | Penfold | 40/13 |
| 462,071 | 10/1891 | Abbey | 40/13 |
| 2,085,285 | 6/1937 | Zakos | 40/312 |
| 2,094,051 | 9/1937 | Zakos | 40/312 |
| 4,362,244 | 12/1982 | Cornou | 40/324 |

*Primary Examiner*—Gene Mancene
*Assistant Examiner*—Wenceslao J. Contreras
*Attorney, Agent, or Firm*—Fred Philpitt

[57] ABSTRACT

A card sandwiching member is mounted on a storing box which is formed integrally with a frame like elastic holding plate on one surface of the mounting base plate in almost a rectangular shape made of elastic material, and a card bearing information related to an article stored in the storing box is sandwiched and retained on the outer surface of the side wall of the storing box by an elastic holding member, and the storing box is formed integrally with a flange on the outer surface of the side wall, and engaging members are formed integrally on the outer surface of the side wall spaced apart from one surface of the flange so as to be projected, and hook portions bending to the side of the flange are formed integrally on the tips of the engaging members, and the card sandwiching member is sandwiched and retained between the outer surface of the side wall of the storing box and the inside surface of the hook portion by inserting the mounting base plate between the flange of the storing box and the engaging members.

4 Claims, 3 Drawing Sheets

CONTAINER AND CLIP ASSEMBLY

BACKGROUND OF THE INVENTION

This invention relates to a mounting structure of a card sandwiching member provided in a storing box, and more particularly to a mounting structure of a card sandwiching member provided in the storing box in which flanges are formed integrally on an outer surface of the side wall thereof, and engaging members are formed integrally on an outer surface of its side wall spaced apart at a fixed interval from one surface of the flange so as to be projected, and hook portions curved to the sides of the flanges are integrally formed on tips of the engaging members, and the card sandwiching member is formed integrally with a frame like elastic holding plate on one surface of a mounting base plate of almost rectangular shape which is made of an elastic material, and notched inclined surfaces fitted to the engaging members of the storing box which are near both end portions of the mounting base plate and ⊐-shaped notched engaging portions are provided, and the mounting base plate of the card sandwiching member is inserted between the flanges of the storing box and the engaging members with its notched inclined surfaces and the engaging portions so that the mounting base plate of the card sandwiching member is sandwiched and retained by the outer surface of the side wall of the storing box and a surfaces of inside of the hook portions.

In today's industry, as a method of handling products, products are stored in the storing box such as arranging box and the like, and posting of a card bearing an information necessary for the stored product on the outer surface of the side wall of the storing box is the most rational means of the handling and such a method is gradually becoming popular in the industry. For example, in automobile's component parts manufacturing plant, a means of handling the component parts by posting a card bearing a necessary information about the stored product in the storing box on the outer surface of the side wall of the storing box is employed for transportation of the completed component parts to an assembly plant, storage in wearhouse, delivery and control of the parts to be used in each stage of operations, management of storage, and management of quantity and the like.

A variety of methods can be enumerated for posting the card on the storing box, but as one of the methods, the card is sandwiched and retained simply and strongly on the outer surface of the side wall of the storing box by means of the card sandwiching member, namely, the card sandwiching member made of the elastic material being mounted on the storing box and the card is resiliently retained on the outer surface of the side wall of the storing box by the elastic holding plate of the card sandwiching member.

However, in the method of sandwiching the card by the card sandwiching member, as a means for providing the card sandwiching member on the storing box, generally a means of fixing the card with riveting or soldering had been primarily employed heretofore, but in case of employing this type of fixing means, not only a special too such as a riveting tool or soldering iron was required but also, a troublesome exchange of the card was required, and therefore, in case the card sandwiching member was broken, it presented an inconvenience. Also, as another method, there was a structure of simply mounting the card sandwiching member, but in general, there was a drawback that the card sandwiching member was easily removed during the use despite the simple mounting.

SUMMARY OF THE INVENTION

An object of this invention is to provide a mounting structure of a card sandwiching member provided in a storing box in which flanges are formed integrally on an outer surface of the side wall thereof, and engaging members are formed integrally on an outer surface of its side wall spaced apart at a fixed interval from one surface of the flange so as to be projected, and hook portions curved to the sides of the flanges are integrally formed on tips of the engaging members, and the card sandwiching member is formed integrally with a frame like elastic holding plate on one surface of a mounting base plate of almost rectangular shape which is made of an elastic material, and notched inclined surfaces fitted to the engaging members of the storing box which are near both end portions of the mounting base plate and ⊐-shaped notched engaging portions are provided, and the mounting base plate of the card sandwiching member is inserted between the flanges of the storing box and the engaging members with its notched inclined surfaces and the engaging portions so that the mounting base plate of the card sandwiching member is sandwiched and retained by the outer surface of the side wall of the storing box and a surfaces of inside of the hook portions whereby no special tool is required for mounting the card sandwiching member on the storing box, and it can be simply mounted, and also the mounting is strongly carried out.

DETAILED DESCRIPTION OF THE INVENTION

Figure 1:
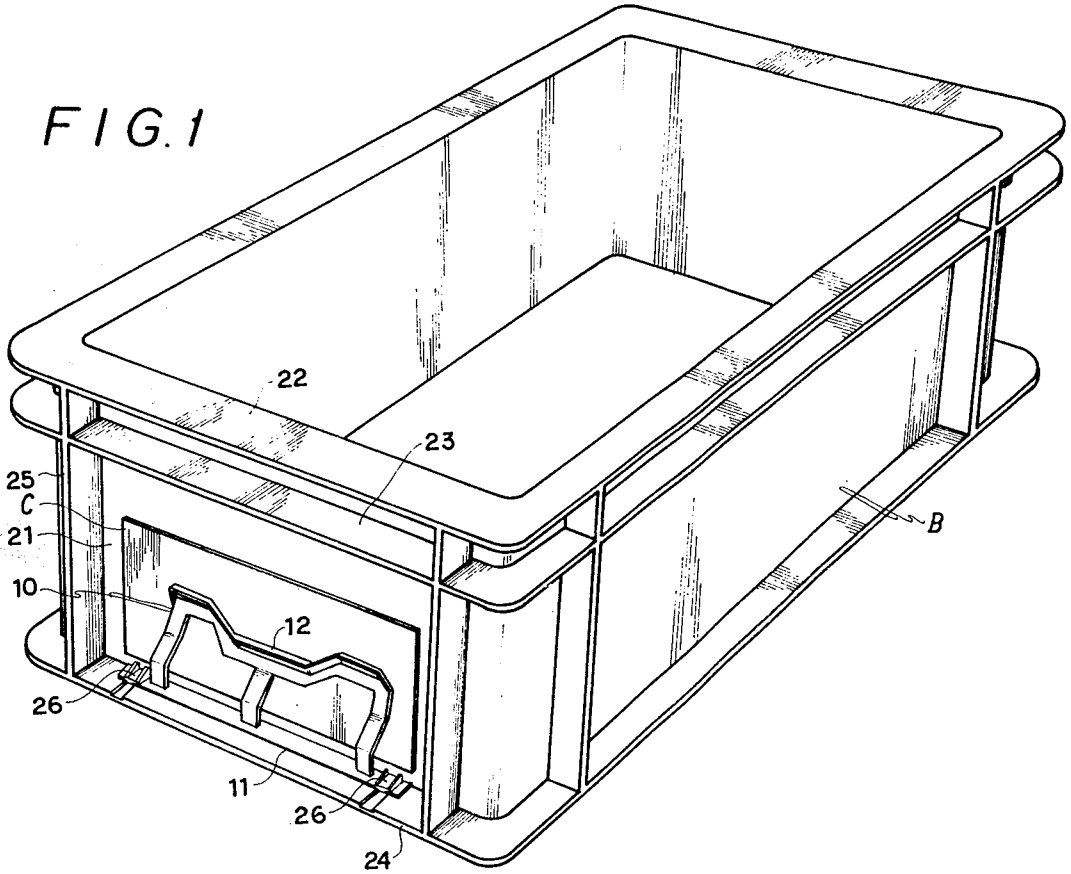
FIG. 1 is a perspective view of a storing box mounted with a card sandwiching member.

On the side wall 21 of the storing box B that is molded integrally by synthetic resin which is represented by an ordinary letter B, as shown in FIG. 1, a card sandwiching member 10 is provided which is molded integrally by synthetic resin having resiliency, and a card C bearing a necessary information related to a product or article stored in the storing box B is detachably retained on an outer surface of the side wall 21 of the storing box B by the card sandwiching member 10.

The card sandwiching member 10 whose entire body is formed by semitransparent synthetic resin material having resiliency, and an elastic holding member 12 is formed integrally on one surface of a mounting base plate 11 of almost a rectangular shape. Namely, three pieces of support legs 13, 13, 14 which are erected at intervals on the mounting base plate 11 are curved in almost ⊐-shape in the direction (side surface) opposing the side wall 21 of the storing box B, and a sandwiching portion 15 of almost ⊐-shape (elevation) is mounted to connect upper end portions of each support leg 13, 13, 14. The sandwiching portion 15 is formed in such a way that its upper side portion is bent in the opposite direction. However, notched inclined surfaces 17, 17 whose upper surface is in an upward inclined form from side edge are formed on the side edge opposed to the side wall 21 of the storing box B towards both end portions of the mounting base plate 11. Also, ⊐-shaped notched engaging portions 18, 18 are formed on the side edge of opposite side where the notched inclined surfaces 17, 17 are formed.

Figure 2:
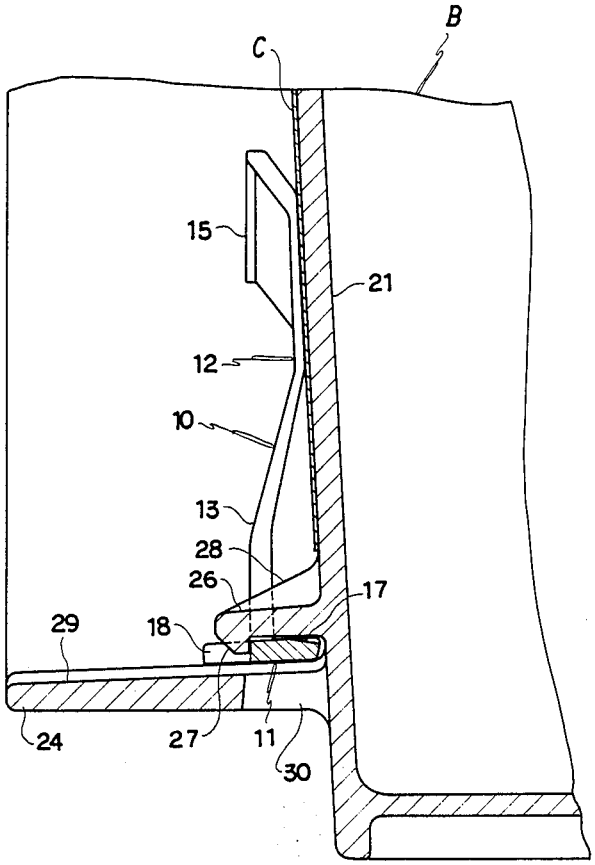
FIG. 2 is a vertical cross section of a mounting portion of the storing box and card sandwiching member.
Figure 3:
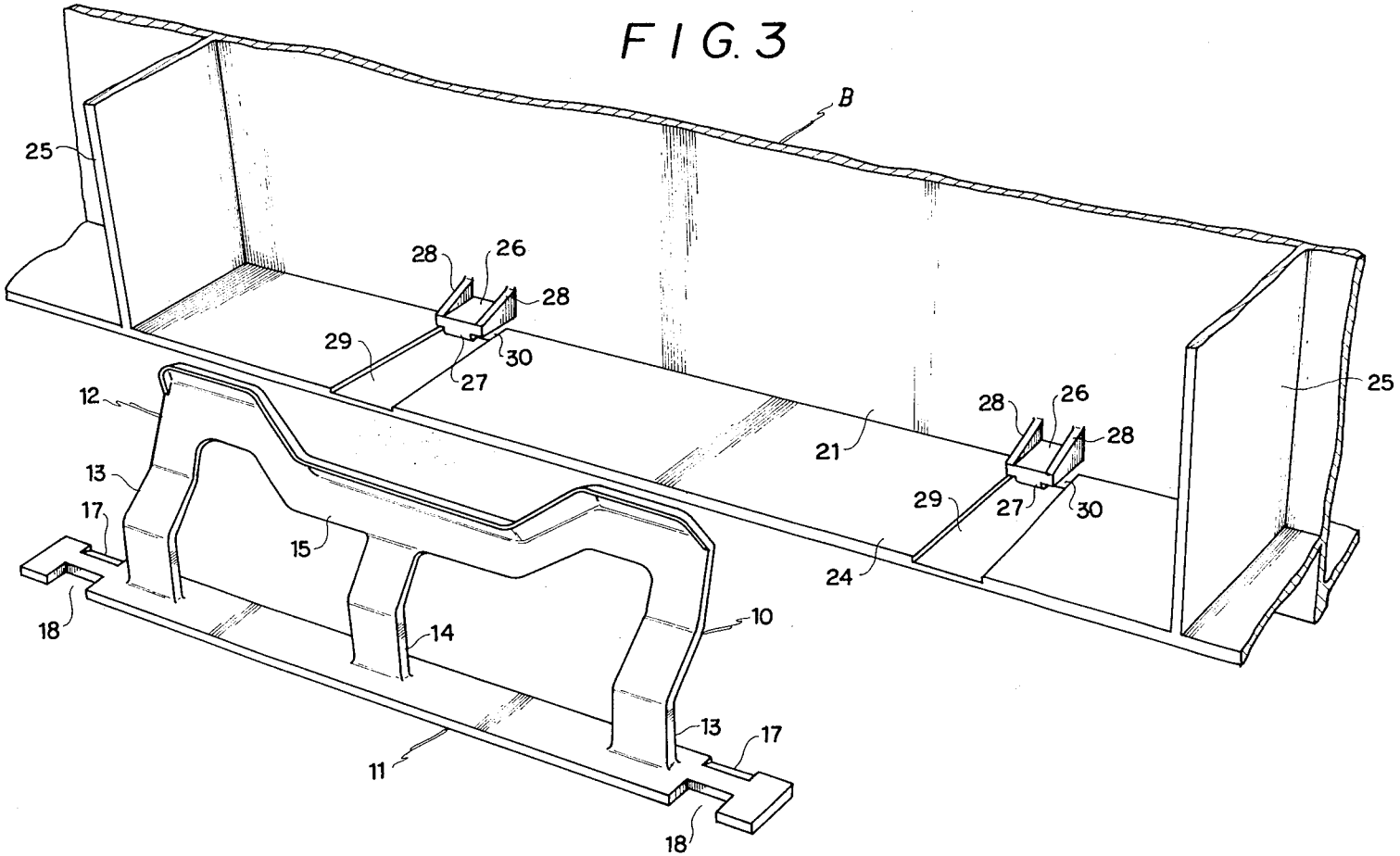
FIG. 3 is an exploded perspective view showing the mounting portion of the storing box and card sandwiching member in enlarged form.

On the other hand, flanges 22, 23, 24 and vertical ribs 25 are integrally formed for reinforcement on the outer surface of the side wall 21 of the storing box B. Engaging members 26, 26 are formed integrally on the outer surface of the side wall 21 spaced apart at fixed intervals from the upper surface of the flange 24 toward the bottom portion so as to be projected. The engaging members 26, 26 are formed integrally with hook portions 27, 27 at their tips which are bent towards the side of the flange 24. By the way, reference numeral 28, 28 denote reinforcing ribs formed integrally on the upper surfaces of the engaging members 26, 26 for reinforcement of the engaging members 26, 26. Furthermore, shallow grooves 29, 29 are formed on the upper surface of the flange 24 opposed to the engaging members 26, 26 so that their width is broader than that of the engaging members 26, 26. Reference numerals 30, 30 denote perforated holes that open to the flange 24 which are necessary for forming the engaging members 26, 26 by an injection molding metal mold. The card mounting member 10 is constructed in such a way that in case the mounting base plate 11 is placed on the flange 24 to be moved on the flange 24 towards the side wall 21, the hook portions 27, 27 of the tips of the engaging members 26, 26 slide on the notched inclined surfaces 17, 17, and the engaging members 26, 26 are elastically deformed in the upper direction. The engaging members 26, 26 are restored resiliently to their original shape as the hook portions 27 27 are fitted to the engaging portions 18, 18, and as shown in FIG. 2, the mounting base plate 11 sandwiched between the outer surface of the side wall 21 and the inner surface of the hook portion 27. By the way, the required deformation amounts of the engaging members 26, 26 are reduced by deforming the mounting plate 11 to be curved in the grooves 29, 29 while the hook portions 27, 27 slide on the inclined surfaces 17, 17 to be fitted into the engaging portions 18, 18, and the plastic deformations of the engaging members 26, 26 can be prevented to a minimum.

EFFECT OF THE INVENTION

As described with respect to the foregoing embodiment, according to this invention, the mounting base plate is sandwiched by the outer surface of the side wall of the storing box and the inside surface of the hook portions by merely inserting the mounting base plate of the card sandwiching member between the flange of the storing box and the engaging members. Because of the foregoing arrangement, a special tool is not required, and the mounting can be made strongly, and moreover, there is no accidental detachment during the use, and the structure is simple, and it can be formed integrally on the storing box and the card sandwiching member, whereby a useful effect can be obtained when used since no cost of mounting is required.

What is claimed is:

1. A storage box having walls defining an interior space to receive materials to be stored, said storage box including a card sandwiching arrangement associated with one of the exterior walls of said storage box which will hold a card adjacent one exterior wall of said storage box so that information on the card can be read to identify the materials contained within the interior of said storage space, said card sandwiching arrangement comprising (a) a flange (24) extending outwardly from one side (21) of said box (B), (b) a frame-like elastic holding plate (10, 12, 13) that is shaped and sized so that a portion of the holding plate (10, 12, 13) can resiliently press a card (C) against one exterior side (21) of the box (B), (c) first engaging means (17, 18) located on a portion of said frame-like elastic holding plate (10, 12, 13), (d) second engaging means (26, 27, 28 and 29) located on said side wall (21), side first (17,18) and second (26, 27, 28, 29) engaging means being shaped and sized so that when they are interengaged they will lock together to thereby hold said frame-like holding plate (10, 12, 13) in a pressing relationship against one exterior side (21) of the box (B).

2. A storage box according to claim 1 wherein said flange (24) is provided with a shallow groove (29) which guides said first engaging means (17, 18) into interengagement with said second engaging means (26, 27, 28).

3. A storage box according to claim 2 wherein the inner end of said shallow groove (29) terminates in a hole (30) located immediately beneath said second engaging means (26, 27, 28).

4. A storage box according to claim 1 which includes a rectangular arrangement of flanges (23, 24, 25).

* * * * *